US011439256B2

(12) United States Patent
Dungan et al.

(10) Patent No.: US 11,439,256 B2
(45) Date of Patent: Sep. 13, 2022

(54) APPARATUS FOR RETAINING COLLAPSIBLE TOTES

(71) Applicant: Toshiba Global Commerce Solutions Holdings Corporation, Tokyo (JP)

(72) Inventors: William L. Dungan, Cary, NC (US); Thomas E. Hoppe, Raleigh, NC (US)

(73) Assignee: Toshiba Global Commerce Solutions Holdings Corporation, Tokyo (JP)

( * ) Notice: Subject to any disclaimer, the term of this patent is extended or adjusted under 35 U.S.C. 154(b) by 0 days.

(21) Appl. No.: 17/125,432

(22) Filed: Dec. 17, 2020

(65) Prior Publication Data

US 2022/0192397 A1 Jun. 23, 2022

(51) Int. Cl.

| | |
|---|---|
| ***A47F 9/04*** | (2006.01) |
| ***A47F 5/08*** | (2006.01) |
| ***A47F 13/08*** | (2006.01) |
| ***B65B 67/12*** | (2006.01) |

(52) U.S. Cl.

CPC ..... *A47F 9/042* (2013.01); *A47F 5/0884* (2013.01); *A47F 13/085* (2013.01); *B65B 67/1227* (2013.01); *B65B 67/1233* (2013.01); *A47F 2009/041* (2013.01)

(58) Field of Classification Search

CPC ..... A47F 9/042; A47F 5/0884; A47F 13/085; A47F 2009/041; A47F 7/16; A47F 7/143; B65B 67/1227; B65B 67/1233; B65B 67/12; B65B 2067/1294; A47G 23/0258; A47G 2025/1492; A47G 25/74; A47G 25/743

USPC ..... 211/12, 85.15, 70.8, 70.7, 67, 65, 61, 211/70.6, 46, 59.4, 45; 248/95, 99, 100, 248/101

See application file for complete search history.

(56) References Cited

U.S. PATENT DOCUMENTS 2,563,754 A * 8/1951 Soref ..... A47F 5/0876 211/85.9
3,306,507 A * 2/1967 Wilson ..... A45F 5/10 294/169
3,473,671 A * 10/1969 Gangitano ..... A47B 97/02 211/45
4,407,474 A * 10/1983 Swenson ..... B65B 67/1227 248/97

(Continued)

OTHER PUBLICATIONS

"Window Clips", https://www.mcmaster.com/window-clips/window-clips/, McMaster, [Accessed Online Dec. 2, 2020], 1 page.

(Continued)

*Primary Examiner* — Jennifer E. Novosad
(74) *Attorney, Agent, or Firm* — Patterson + Sheridan, LLP

(57) ABSTRACT

An apparatus is disclosed for retaining a collapsible tote. The apparatus comprises a base, a projecting member having a first end attached to the base, and an engagement member attached to the projecting member at a second end opposite the first end. The engagement member defines one or more slots extending into the engagement member from a top surface. At each slot of the one or more slots, portions of the engagement member that define the slot are configured to, responsive to receiving a respective portion of a handle of the collapsible tote into the slot, apply a force to retain the respective portion of the handle.

14 Claims, 12 Drawing Sheets

(56) References Cited

U.S. PATENT DOCUMENTS 4,437,634 A * 3/1984 Hambleton ..... B65B 67/1227 220/495.11
4,669,689 A * 6/1987 Jones ..... B65B 67/1227 248/152
4,838,504 A * 6/1989 Bittenbinder ..... B65B 67/1227 248/100
4,881,706 A * 11/1989 Sedlik ..... B65B 67/1227 248/99
RE33,122 E * 12/1989 Orem ..... A47F 9/042 53/459
5,050,825 A * 9/1991 Bratset ..... B60R 7/02 248/97
5,131,499 A * 7/1992 Hoar ..... B65B 67/04 186/66
5,160,103 A * 11/1992 Breitenstein ..... B65B 67/1227 248/100
5,213,145 A * 5/1993 Huang ..... A47F 13/085 141/314
5,269,416 A * 12/1993 DeMatteis ..... A47F 9/042 211/50
5,366,189 A * 11/1994 Thompson ..... B60R 7/02 224/539
5,368,393 A * 11/1994 Normann ..... A45F 5/1026 294/170
5,464,102 A * 11/1995 LeBlanc ..... B60R 7/02 211/12
5,487,475 A * 1/1996 Knee ..... A47B 81/005 211/70.8
5,639,051 A * 6/1997 Surbeck ..... B65B 67/1216 248/100
5,678,700 A * 10/1997 Crosson, Jr. ..... A01K 97/10 211/60.1
D398,429 S * 9/1998 LeBlanc ..... D34/6
5,813,734 A * 9/1998 Ong ..... B42F 15/04 312/184
5,863,092 A * 1/1999 Kifer ..... B60R 7/043 297/188.04
D409,913 S * 5/1999 Le Roux ..... D9/434
5,979,102 A * 11/1999 Sagryn ..... A01K 97/08 114/364
6,042,063 A * 3/2000 Kerr ..... B65B 67/1227 248/100
6,059,126 A * 5/2000 Miller ..... B65B 67/1227 211/12
6,098,933 A * 8/2000 Stein ..... B65F 1/1415 248/99
6,152,408 A * 11/2000 O'Grady ..... B65B 67/1227 248/100
6,244,447 B1 * 6/2001 Frieze ..... A61L 2/07 206/370
6,325,214 B1 * 12/2001 Smithson ..... B65D 33/001 206/554
6,375,017 B1 * 4/2002 Schattner ..... A61M 5/1418 211/70
6,375,131 B1 * 4/2002 Youst ..... B65B 67/1211 248/101
6,460,814 B1 * 10/2002 Bolick ..... B65B 67/1227 248/95
6,629,615 B2 * 10/2003 Kim ..... F16L 3/223 211/85.13
6,669,067 B2 * 12/2003 Schuster ..... B60R 7/02 211/12
6,726,156 B1 * 4/2004 Scola ..... B65B 67/1227 248/100
7,243,884 B2 * 7/2007 Lawson ..... B65B 67/1216 211/12
7,503,459 B2 * 3/2009 Grayson ..... A47B 81/005 211/70.8
7,887,068 B2 * 2/2011 Ferguson ..... B62B 1/14 280/33.992
8,882,061 B2 * 11/2014 Marsh ..... A47F 13/085 248/100
8,905,411 B1 12/2014 Blanton
9,055,829 B1 6/2015 Marsh
9,310,018 B2 * 4/2016 Laitila ..... A47F 13/085
9,578,937 B2 * 2/2017 Kern ..... A45C 3/04
9,622,598 B1 * 4/2017 Davis, Jr. ..... B65B 67/1266
9,622,599 B2 * 4/2017 Davis, Jr. ..... A47F 13/085
10,220,866 B2 * 3/2019 Bacallao ..... B62B 3/106
10,634,183 B2 * 4/2020 Matthews ..... F16B 45/00
11,136,156 B1 * 10/2021 Barr ..... B65B 67/1227
2003/0205497 A1 * 11/2003 Strickland ..... B65B 67/1266 206/554
2005/0114216 A1 * 5/2005 Lantz ..... A47F 9/046 705/16
2007/0278359 A1 * 12/2007 Kandah ..... B65B 67/1216 248/99
2009/0020657 A1 * 1/2009 Dayton ..... B65B 67/1227 248/100
2010/0021088 A1 1/2010 Wilfong, Jr.
2010/0314507 A1 12/2010 Laitila et al.
2011/0011921 A1 * 1/2011 Sorensen ..... B65B 67/1205 229/115
2015/0048039 A1 2/2015 Laitila et al.
2017/0020307 A1 * 1/2017 Davis, Jr. ..... B65B 67/1266
2017/0217621 A1 * 8/2017 Robinson ..... B65B 67/1233
2021/0298495 A1 * 9/2021 Barr ..... B65B 67/1227

OTHER PUBLICATIONS

"Genuine MINI-82260306812-Grocery Bag Holder", ECS Tuning, https://www.ecstuning.com/b-genuine-mini-parts/grocery-bag-holder/82260306812 [Accessed Online Dec. 2, 2020], 3 pages.
"Fujitsu U-Scan Genesis II Self-Checkout," ECRS, https://www.ecrs.com/retail-pos/hardware/self-checkout/fujitsu-genesis/ [Accessed Online Dec. 2, 2020], 5 pages.
"SGKLS Curved Sign Clip Gripper" http://jxlabelholder.com/products/Clear-Grip-Sign-Holder-24.html [Accessed Online Dec. 2, 2020].

* cited by examiner

APPARATUS FOR RETAINING COLLAPSIBLE TOTES

BACKGROUND

The present disclosure relates to checkout systems, and more specifically to an apparatus for retaining collapsible totes.

Reusable totes (which are sometimes referred to as "reusable shopping bags", "reusable grocery bags," and so forth) have increased in popularity as an environmentally-friendly alternative to single-use plastic bags. Further, several cities and states have enacted legislation limiting or eliminating the use of single-use plastic bags (sometimes referred to as "t-shirt bags"). However, current bagging stations are primarily focused on dispensing and/or retaining the single-use plastic bags during the bagging process, and are not well-adapted for the structural differences (dimensioning, sidewall strength, weight capacity, etc.) of the reusable totes.

SUMMARY

According to one embodiment, an apparatus is disclosed for retaining a collapsible tote. The apparatus comprises a base, a projecting member having a first end attached to the base, and an engagement member attached to the projecting member at a second end opposite the first end. The engagement member defines one or more slots extending into the engagement member from a top surface. At each slot of the one or more slots, portions of the engagement member that define the slot are configured to, responsive to receiving a respective portion of a handle of the collapsible tote into the slot, apply a force to retain the respective portion of the handle.

According to another embodiment, a self-checkout system comprises one or more platforms and a plurality of bagging stations. Each bagging station comprises a base attached with a platform of the one or more platforms, a projecting member having a first end attached to the base, and an engagement member attached to the projecting member at a second end opposite the first end. Each engagement member defines one or more slots extending into the engagement member from a top surface. At each slot of the one or more slots, portions of the engagement member that define the slot are configured to, responsive to receiving a respective portion of a handle of the collapsible tote into the slot, apply a force to retain the respective portion of the handle.

BRIEF DESCRIPTION OF THE SEVERAL VIEWS OF THE DRAWINGS

So that the manner in which the above recited aspects are attained and can be understood in detail, a more particular description of embodiments of the disclosure, briefly summarized above, may be had by reference to the appended drawings. It is to be noted, however, that the appended drawings illustrate only typical embodiments of the disclosure and are therefore not to be considered limiting of its scope, for the disclosure may admit to other equally effective embodiments.

DETAILED DESCRIPTION

Aspects of the current disclosure relate to an apparatus for retaining a collapsible tote. The apparatus comprises a base, a projecting member having a first end attached to the base, and an engagement member attached to the projecting member at a second end opposite the first end. The engagement member defines one or more slots extending into the engagement member from a top surface. At each slot of the one or more slots, portions of the engagement member that define the slot are configured to, responsive to receiving a respective portion of a handle of the collapsible tote into the slot, apply a force to retain the respective portion of the handle.

In some embodiments, the engagement member is formed of a flexible material. For example, the portions of the engagement member that define the slot may repeatably deform or pivot from a neutral position responsive to receiving the respective portion of the handle into the slot. The elastic properties of the material provide the retaining force when the handle is inserted into the slots, and returns the portions of the engagement member to the neutral position when the handle is removed from the slots. In some embodiments, one or more external biasing elements (such as springs or spring-loaded hinges) may urge the portions of the engagement member to the neutral position.

Beneficially, retaining the collapsible tote using the engagement member may ease the bagging process for customers and/or associates. For example, retaining the collapsible tote may free one or both hands of a customer to place items from a shopping cart into the collapsible tote. Further, engaging the handle with the engagement member may urge and/or maintain a main storage compartment of the collapsible tote in an uncollapsed configuration, easing the process of placing items into the collapsible tote.

While features of the tote-retaining apparatus are generally discussed within the context of a shopping environment, such as within a self-checkout system of a retail store, it is contemplated that the techniques disclosed herein may be applied to other environments (some non-limiting examples include libraries, museums, classrooms, hospitals, etc.).

Figure 1B:
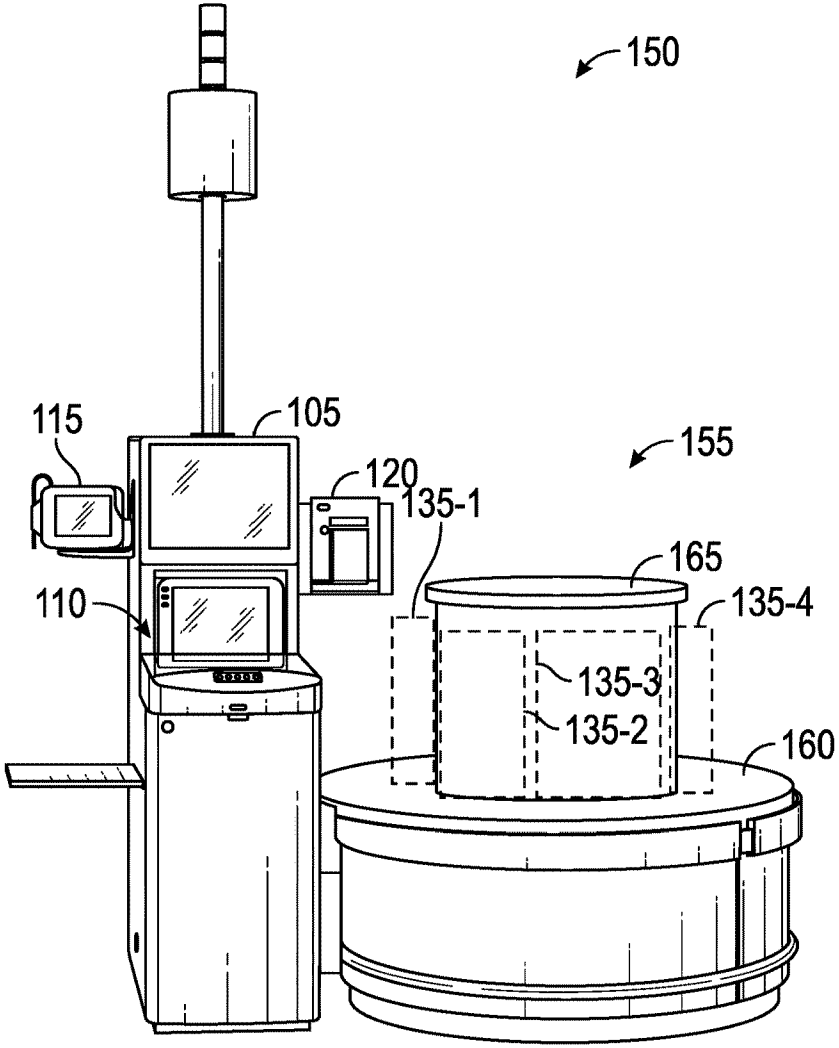
FIG. 1B illustrates an exemplary implementation of a self-checkout system with bagging stations on a carousel, according to one or more embodiments.
Figure 1A:
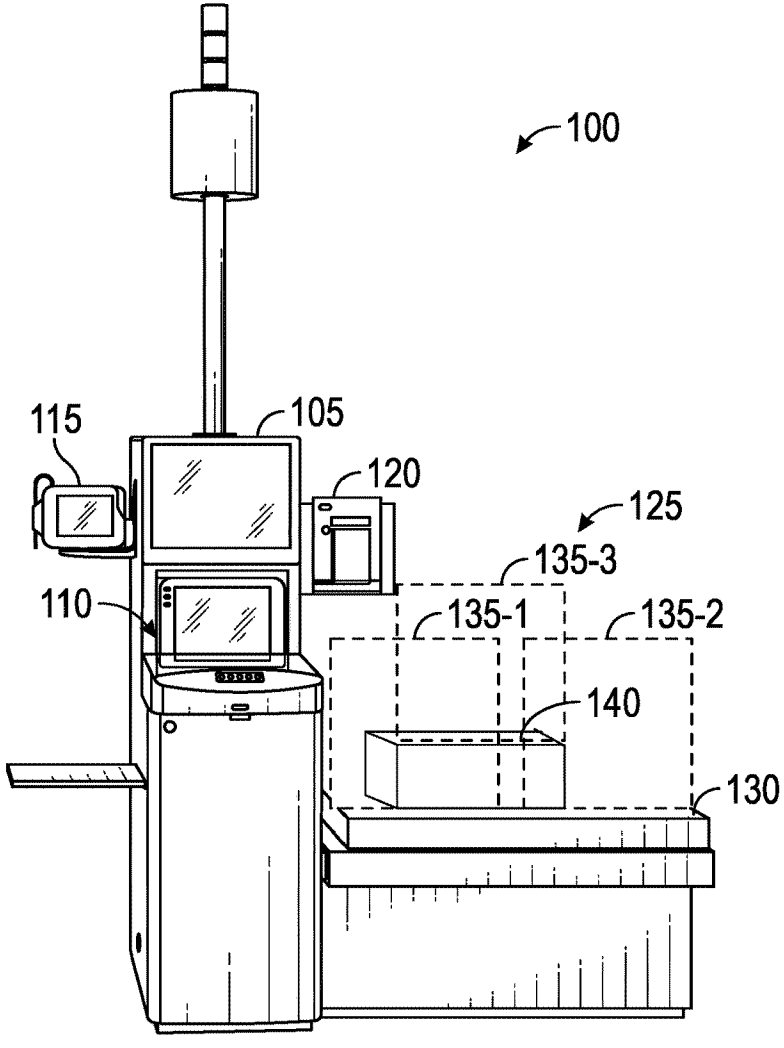
FIG. 1A illustrates an exemplary implementation of a self-checkout system with bagging stations on multiple levels, according to one or more embodiments.

FIG. 1A illustrates an exemplary implementation of a self-checkout system 100 with bagging stations on multiple levels, according to one or more embodiments. The self-checkout system 100 generally has functionality supporting some or all of the stages of a self-checkout transaction, such as scanning items, weighing items, bagging items, and presenting payment.

The self-checkout system 100 comprises a display 105 that presents information viewable by a user (e.g., a customer or an associate) during various stages of a self-checkout transaction. The display 105 is communicatively coupled with one or more computer processors, which may be integrated with the self-checkout system 100 or external to the self-checkout system 100. For example, the one or more computer processors may be included in a computing device integrated with the self-checkout system 100, which may be further networked with other computing devices. In some embodiments, the display 105 comprises a display screen using any suitable display technology, such as a liquid crystal display (LCD), an organic light-emitting diode (OLED) display, and so forth. In some embodiments, the display 105 receives inputs from the user during the self-checkout transaction. For example, the display 105 may be implemented as a touch-sensitive screen using any suitable sensing technology, such as capacitive sensing, resistive sensing, and so forth.

The self-checkout system 100 further comprises an item scanner 110. The item scanner 110 is communicatively coupled with the one or more computer processors, and in conjunction with the one or more computer processors visually identifies items during scanning. For example, the item scanner 110 may detect encoded portions (e.g., a Universal Product Code (UPC), a Quick Response (QR) code) and/or may compare imagery of the item with reference image(s) to identify a type of the item. In some embodiments, the item scanner 110 may further include one or more load cells for measuring weights of items.

The self-checkout system 100 further comprises a payment receiver 115. In some embodiments, the payment receiver 115 comprises a credit card terminal communicatively coupled with the one or more computer processors. Other implementation of the payment receiver 115 are also contemplated. In other embodiments, the self-checkout transaction may be completed without the user presenting payment at the payment receiver 115 (e.g., charged by the one or more computer processors to a customer's account).

The self-checkout system 100 further comprises a printer 120 that prints or otherwise provides tangible items to the user. The printer 120 is communicatively coupled with the one or more computer processors. In some embodiments, the printer 120 generates paper receipts for the self-checkout transaction and/or coupons.

The self-checkout system 100 further comprises a bagging area 125 comprising a plurality of bagging stations 135-1, 135-2, 135-3 (generically, a bagging station 135). As will be discussed in greater detail below, each bagging station 135 includes structure suitable for retaining at least one collapsible tote in a suspended configuration. In some embodiments, each bagging station 135 may also be suitable for dispensing and/or retaining single-use shopping bags.

As shown, the bagging stations 135-1, 135-2 are disposed on a first platform 130, and the bagging station 135-3 is disposed on a raised second platform 140. Use of the first platform 130 and the second platform 140 allows for greater accessibility when bagging items, e.g., without requiring the user having to walk to the other side of the bagging area 125 to access the bagging station 135-3). Other configurations of the bagging stations 135 are also contemplated.

FIG. 1B illustrates another exemplary implementation of a self-checkout system 150 with bagging stations 135 on a carousel 165, according to one or more embodiments. The self-checkout system 150 generally includes comparable structure and functionality to the self-checkout system 100.

As shown, the bagging area 155 comprises a plurality of bagging stations 135-1, 135-2, 135-3, 135-4 that are distributed around a circumference of, and attached to, the carousel 165. Although not shown in the current view, the bagging area 155 may include additional bagging stations 135 on the far side of the carousel 165.

The carousel 165 is capable of rotating relative to a base 160. In other embodiments, the carousel 165 and the base 160 are rigidly connected and able to rotate together, e.g., relative to the floor or other surface on which the self-checkout system 150 is disposed. Attaching the bagging stations 135 to the carousel 165 allows for greater accessibility when bagging items, as a user may simply rotate the carousel 165 to access different bagging stations 135.

Figure 2A:
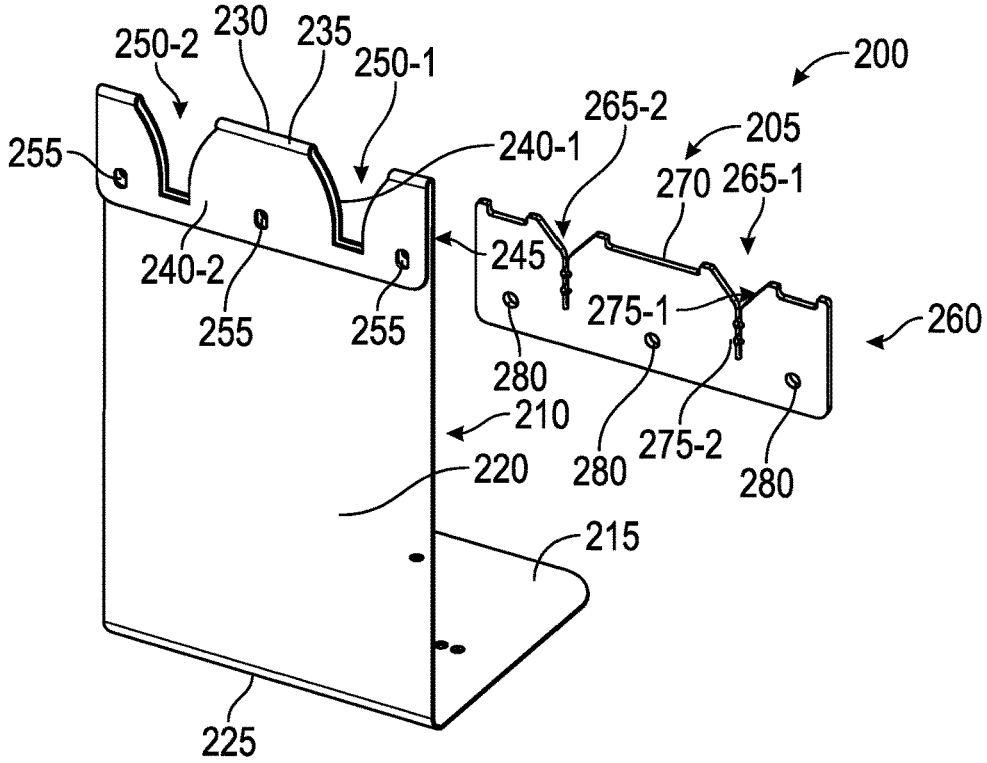
FIG. 2A is an exploded view of an exemplary tote-retaining apparatus, according to one or more embodiments.
Figure 2B:
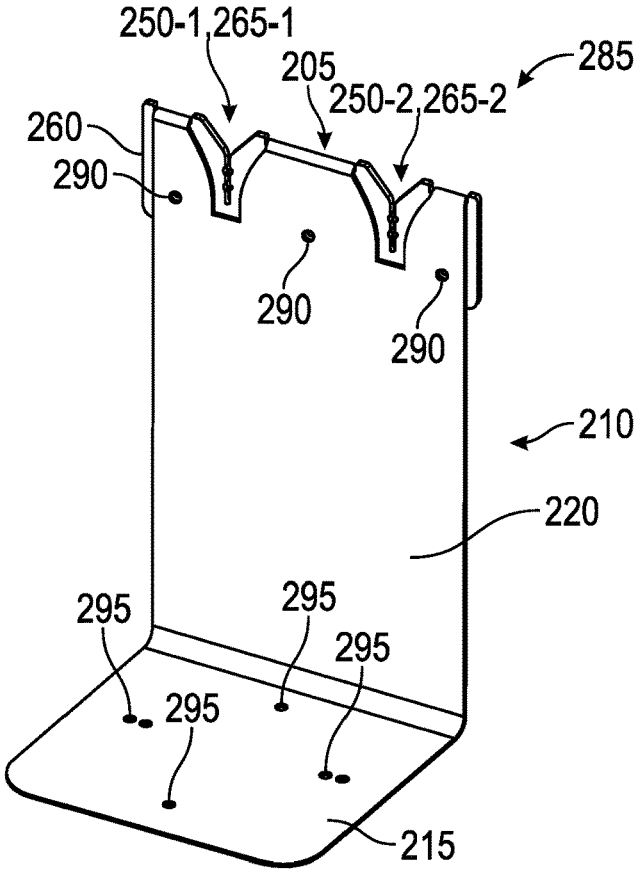
FIG. 2B is a perspective view of an exemplary tote-retaining apparatus, according to one or more embodiments.

FIG. 2A provides an exploded view 200, and FIG. 2B provides a view 285 of an exemplary tote-retaining apparatus 205 (also referred to as an apparatus 205), according to one or more embodiments. The features depicted in the views 200, 285 may be used in conjunction with other embodiments described herein. For example, each bagging station 135 of FIGS. 1A and 1B may include a respective instance of the apparatus 205.

The apparatus 205 comprises a rigid structure 210 that attaches to a platform of a self-checkout system, and to an engagement member 260 that receives and selectively retains a handle of a collapsible tote through force(s) applied to the handle. As discussed herein, "attaching" two components contemplates direct, physical contact between the two components, as well as attachment through one or more intermediate components. The attachments may be permanent (e.g., welded or adhered) or removable (e.g., threaded fasteners). The rigid structure 210 may be implemented as a singular component or an assembly of multiple components.

The rigid structure 210 comprises a base 215 and a projecting member 220 that projects upwardly between a first end 225 and an opposing second end 230. The projecting member 220 is attached to the base 215 at the first end 225, and to the engagement member 260 at the second end 230.

The rigid structure 210 may be constructed of any suitable material(s) and may have any suitable dimensioning for retaining a collapsible tote. In some cases, the height of the projecting member 220 may be selected such that the collapsible tote contacts the base 215 or an underlying surface when the handle of the collapsible tote is engaged with the engagement member 260. In other cases, the height of the projecting member 220 may be selected such that the collapsible tote may be suspended (e.g., not resting on the base 215 or on another underlying surface when engaged with the engagement member 260.

The material(s) and thickness(es) of the projecting member 220 may be selected to support the weight of the collapsible tote in addition to a predefined weight for items stored therein. For example, the projecting member 220 may be dimensioned to support the collapsible tote and at least fifty (50) pounds of items. In some embodiments, the projecting member 220 comprises a metal, such as spring steel or aluminum, having suitable yield strength to suspend the collapsible tote (and any items stored therein) without causing a plastic deformation of the projecting member 220.

In some embodiments, the base 215 and the projecting member 220 are integrally formed (e.g., formed from bending a single sheet of spring steel). Other techniques for attaching the base 215 and the projecting member 220 are also contemplated. For example, the base 215 and the projecting member 220 may be welded together or fastened together using a threaded fastener. In alternate implementations of the tote-retaining apparatus 205, the base 215 may be omitted (e.g., the projecting member 220 is attached to other structure of the bagging station).

In some embodiments, the base 215 has a horizontal orientation when the tote-retaining apparatus 205 is arranged in a bagging station. In some embodiments, one or more openings 295 extend through the base 215. Each of the openings 295 is dimensioned to receive a threaded fastener (e.g., a bolt) therethrough. In this way, the projecting member 220 may be removably attached (e.g., retrofitted) via the base 215 to other structure of the bagging station. In some embodiments, the one or more openings 295 correspond to a standardized bolt pattern for the bagging station. In some cases, the one or more openings 295 may be arranged such that the tote-retaining apparatus 205 may be attached to the bagging station with different orientations. In this way, the tote-retaining apparatus 205 may be suitable for retrofitting to existing bagging station designs.

Other techniques for attaching the projecting member 220 to the bagging station are also contemplated. In one example, the projecting member 220 may have one or more openings extending therethrough, allowing threaded fasteners to be received therethrough. In another example, the projecting member 220 may be integrated into the bagging station.

As shown, the projecting member 220 defines a first, substantially planar surface and an opposing second, substantially planar surface. The first surface and the second surface extend parallel to each other and are coextensive with each other. However, other shapes and relative orientations of the first surface and the second surface (including non-coextensive arrangements) are also contemplated. For example, the first surface and the second surface of the projecting member 220 are shown as having a substantially rectangular profile, but other shapes are also contemplated (e.g., an hourglass profile).

Generally, the collapsible tote may be configured in a selected one of a collapsed configuration (e.g., where the main storage compartment of the collapsible tote is substantially closed, such as the collapsible tote is folded up) and an uncollapsed configuration (e.g., where the main storage compartment is opened and able to receive items). In some embodiments, the first surface and/or the second surface is inclined with an inclination angle θ, which tends to gravitationally urge a collapsible tote toward an uncollapsed configuration when the collapsible tote is suspended beside the first surface. In some embodiments, the inclination angle θ is between about seven (7) degrees and about thirty (30) degrees less than a vertical orientation. For example, the inclination angle θ may be between about ten (10) degrees and about twelve (12) degrees less than the vertical orientation. Other values of the inclination angle θ are also contemplated, which may include a vertical orientation of the first surface.

In some embodiments, the projecting member 220 is inclined with the inclination angle θ, and each of the first surface and the second surface is inclined with the inclination angle θ. In other embodiments, differing thicknesses of the projecting member 220 (which may be in combination with an inclination of the projecting member 220) provide the first surface with the inclination angle θ.

As shown, the first surface is inclined in the direction of extent of the base 215 (e.g., forming an acute angle between the base 215 and the first surface). In other implementations, the first surface may be inclined away from the base 215 (e.g., forming an obtuse angle).

In some embodiments, the projecting member 220 defines a bend portion 235 between two flange portions 240-1, 240-2. As shown, the bend portion 235 defines the second end 230 of the projection member 220. The engagement member 260 may be received in a channel 245 defined between the flange portions 240-1, 240-2. The width of the channel 245 may be approximately the same or greater than the thickness of the engagement member 260.

As mentioned above, the engagement member 260 receives and selectively retains a handle of a collapsible tote. The engagement member 260 defines one or more slots 265-1, 265-2 extending into the engagement member 260 from a top surface 270. At each slot 265-1, 265-2, portions of the engagement member 260 that define the slot 265-1, 265-2 are configured to repeatably deform or pivot from a neutral position responsive to receiving a respective portion of a handle of the collapsible tote into the slot 265-1, 265-2. As shown, in the neutral position the engagement member 260 is planar, such that the portions of the engagement member 260 are coplanar with the remainder of the engagement member 260. When deformed or pivoted, the portions of the engagement member 260 are no longer coplanar with the remainder of the engagement member 260. Other neutral positions of the engagement member 260 are also contemplated.

In an exemplary sequence, a downward motion of the handle (e.g., by a customer or a store associate) causes the engagement member 260 to deform and/or pivot to receive the handle into the slots 265-1, 265-2. The engagement member 260, in its deformed and/or pivoted state, applies a force to retain the handle in the slots 265-1, 265-2. An upward motion of the handle may overcome the retaining force of the engagement member 260 to release the handle from the slots 265-1, 265-2. After the handle is released, the portions of the engagement member 260 are urged into the neutral position.

In some embodiments, the engagement member 260 is formed of a flexible material. Some non-limiting examples of the flexible material include one or more of silicone, neoprene, polycarbonate, polyethylene, and styrene. In some embodiments, the engagement member 260 is a monolithic piece of the flexible material. In other embodiments, one or more portions of the engagement member 260 are formed of the flexible material, and one or more other portions of the engagement member 260 are formed of another, less flexible or rigid material.

In some embodiments, the elastic properties of the material of the engagement member 260 provides the retaining force when the handle is inserted into the slots 265-1, 265-2 and returns the portions of the engagement member 260 to the neutral position when the handle is removed from the slots 265-1, 265-2. In some embodiments, one or more external biasing elements may urge the portions of the engagement member 260 to the neutral position. For example, one or more springs or spring-loaded components may contact one or more sides of the portions of the engagement member 260.

In the view 285, each slot 265-1, 265-2 is arranged at a respective opening 250-1, 250-2 formed in the bend portion 235 and the two flange portions 240-1, 240-2. In some embodiments, the openings 250-1, 250-2 are formed in the sheet of metal (e.g., by laser cutting) before bending the projecting member 220 to form the bend portion 235.

In some embodiments, the respective portions of the engagement member 260 that define the slots 265-1, 265-2 are dimensioned such that each slot 265-1, 265-2 defines a first slot portion 275-1 that tapers from a first width at the top surface 270 to a smaller, second width. The tapered profile of the first slot portion 275-1 may assist with guiding the handle when inserting the handle into the slots 265-1, 265-2. Further, the shape of the first slot portion 275-1 may visually suggest the use of the tote-retaining apparatus 205 to a customer.

In some embodiments, the respective portions of the engagement member 260 are dimensioned such that each slot 265-1, 265-2 further defines a second slot portion 275-2 extending from the first slot portion 275-1 away from the top surface 270. In some embodiments, the second slot portion 275-2 has a constant width. In other embodiments, the second slot portion 275-2 has a varying width along the extent of the second slot portion 275-2. For example, the respective portions of the engagement member 260 may be tapered, causing the second slot portion 275-2 to narrow as it extends away from the top surface 270. In some cases, the engagement member 260 applies a greater amount of force to retain the handle as the handle is inserted further into the narrowing second slot portion 275-2.

Whether the width of the second slot portion 275-2 is constant or varied, in some embodiments the second slot portion 275-2 defines one or more notches. For example, as shown in the views 200, 285, each second slot portion 275-2 comprises two notches that extend perpendicular to a long axis of the second slot portion 275-2. In some cases, the notches may be beneficial for retaining handle(s) of one or more collapsible totes. For example, a first handle may be inserted into the second slot portion 275-2 and retained at a first notch, and a second handle may be inserted into the second slot portion 275-2 and retained at a second notch.

In some embodiments, and as shown in the view 200, 285, the top surface 270 may be contoured to form one or more stops corresponding to sections of the projecting member 220 at the bend portion 235. In these cases, the one or more stops may limit relative motion of the engagement member 260 and the projecting member 220. In some cases, the one or more stops may extend beyond the second end 230, which may be beneficial to prevent contacting the edges of the projecting member 220 (e.g., by the handles and/or the customer's hands).

The engagement member 260 may be attached to the projecting member 220 using any suitable techniques, which may be permanent (e.g., welded or adhered) or removable (e.g., threaded fasteners). In some embodiments, a plurality of first openings 280 are formed through the engagement member 260, and each of the first openings 280 are aligned with respective second openings 255, 290 that are formed through the two flange portions 240-2, 240-1. In these cases, the engagement member 260 may be attached to the projecting member 220 using fasteners extending through the first openings 280 and through the respective second openings 255, 290.

Figure 3A:
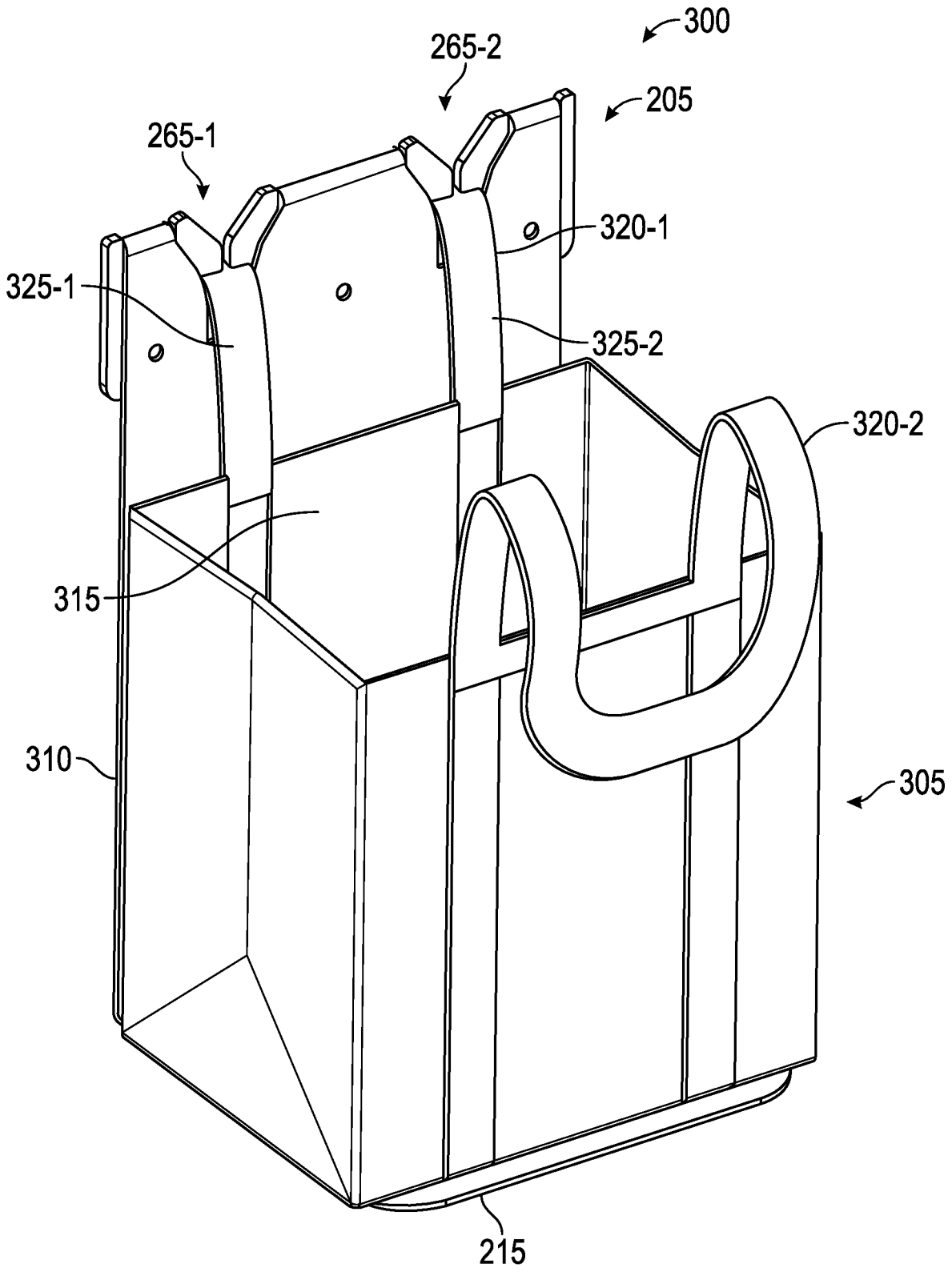
FIG. 3A is a front perspective view of retaining a collapsible tote using an exemplary tote-retaining apparatus, according to one or more embodiments.

FIG. 3A is a front perspective view 300 of retaining a collapsible tote 305 using an exemplary tote-retaining apparatus 205, according to one or more embodiments. The collapsible tote 305 comprises a plurality of sidewalls 310 connected to a base (not shown). The connection of the sidewalls 310 and the base defines a main storage compartment 315 of the collapsible tote 305. The collapsible tote 305 further comprises handles 320-1, 320-2 that are attached to respective sidewalls 310.

The sidewalls 310, the base, and the handles 320-1, 320-2 may be formed of any suitable material(s). Some non-limiting examples of suitable materials include fabric (e.g., canvas), woven natural fibers (e.g., calico, jute) or synthetic fibers, and plastics that are more durable than single-use plastic bags (e.g., non-woven polypropylene when compared to high-density polyethylene).

In some embodiments, the sidewalls 310 and the base are formed of a same material. The handles 320-1, 320-2 may be formed of the same material as the sidewalls 310 and the base, or may be formed of different material(s). The handles 320-1, 320-2 may be connected with the sidewalls 310 using any suitable techniques. In one non-limiting example, the sidewalls 310 and the base are formed of canvas, and the handles 320-1, 320-2 are formed of leather and stitched to the sidewalls 310.

In some embodiments, the sidewalls 310 may include one or more features that encourage the collapsible tote 305 into a collapsed configuration (e.g., where the main storage compartment 315 is substantially closed), such as when the collapsible tote 305 is compactly folded. For example, some or all of the sidewalls 310 may be creased, allowing the collapsible tote 305 to be preferentially collapsed at the creases. The collapsible tote 305 may further comprise a closing mechanism (e.g., hook-and-loop, snaps) capable of maintaining the collapsible tote 305 in the collapsed configuration.

As shown, respective portions 325-1, 325-2 of the handle 320-1 are engaged with the slots 265-1, 265-2 of the apparatus 205. In some embodiments, the height of the projecting member 220 is such that the collapsible tote 305 contacts the base 215 when the handle 320-1 is engaged with the apparatus 205. In other cases, the height of the projecting member 220 is such that the collapsible tote 305 is suspended above the base 215.

In some cases, when the handle 320-1 is engaged with the slots 265-1, 265-2, the collapsible tote 305 may be urged into an uncollapsed configuration by the apparatus 205. In the uncollapsed configuration, the main storage compartment 315 is able to receive items therein. In some embodiments, the collapsible tote 305 contacts the base 215, which may urge the sidewalls 310 to remain spaced apart from each other. In some embodiments, the collapsible tote 305 is suspended above the base 215 and may be gravitationally urged toward the uncollapsed configuration.

Figure 3C:
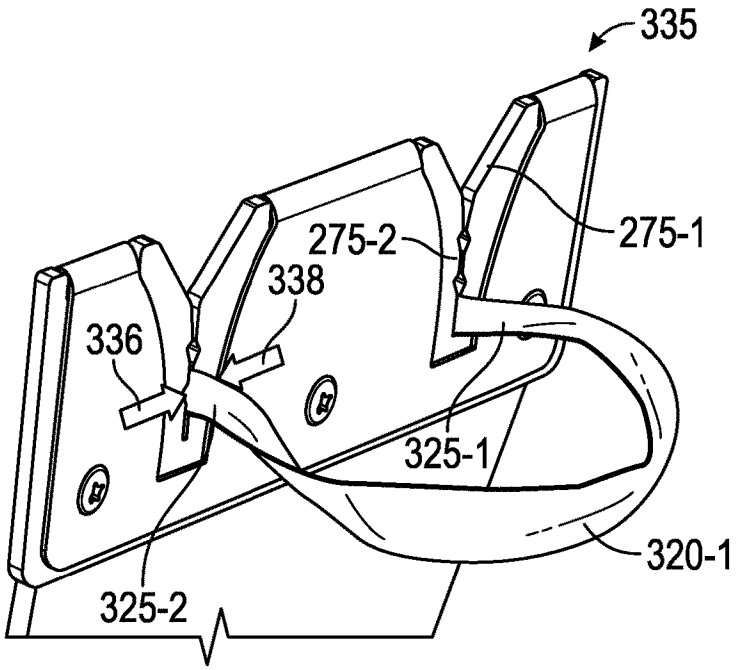
FIG. 3C is a rear perspective view of retaining a collapsible tote using an exemplary tote-retaining apparatus, according to one or more embodiments.
Figure 3B:
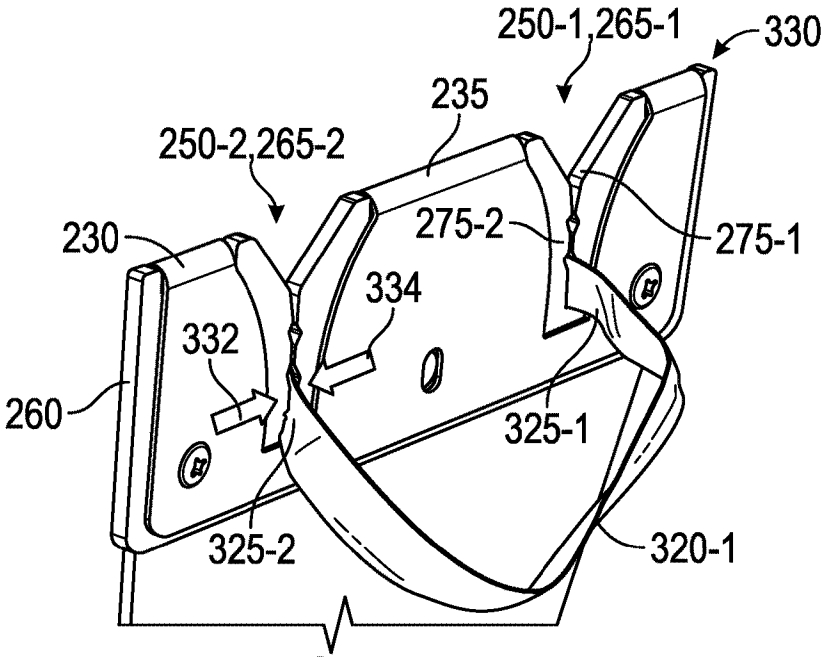
FIG. 3B is a rear perspective view of retaining a collapsible tote using an exemplary tote-retaining apparatus, according to one or more embodiments.

FIGS. 3B and 3C are a rear perspective views 330, 335 of retaining a collapsible tote 305 using an exemplary tote-retaining apparatus 205, according to one or more embodiments. The handle 320-1 of the collapsible tote 305 may be formed of a fabric material and is shown as relatively thin and flat (e.g., having a width dimension greater than a thickness dimension). In the view 330, the handle 320-1 is oriented such that a width dimension of the handle 320-1 is aligned with the long axis of the second slot portion 275-2. The handle 320-1 is inserted into the slots 265-1, 265-2 to a depth such that the engagement member 260 applies forces (shown in the slot 265-2 as arrows 332, 334) to retain the respective portions 325-1, 325-2 of the handle 320-1. In the view 335, the handle 320-1 is folded over on itself when inserted into the slots 265-1, 265-2, and the engagement member 260 applies forces (shown in the slot 265-2 as arrows 336, 338) to retain the respective portions 325-1, 325-2 of the handle 320-1. In the views 330, 335, the forces may be applied by the compliance of the material of the engagement member 260, in some cases within the plane of the engagement member 260. In some embodiments, the portions of the engagement member 260 that define the slots 265-1, 265-2 are configured to repeatably deform or pivot from a neutral position responsive to receiving the respective portions 325-1, 325-2 of the handle 320-1 into the slots 265-1, 265-2. When the handle 320-1 is removed from the slots 265-1, 265-2, the engagement member 260 returns to the neutral position.

Figure 3E:
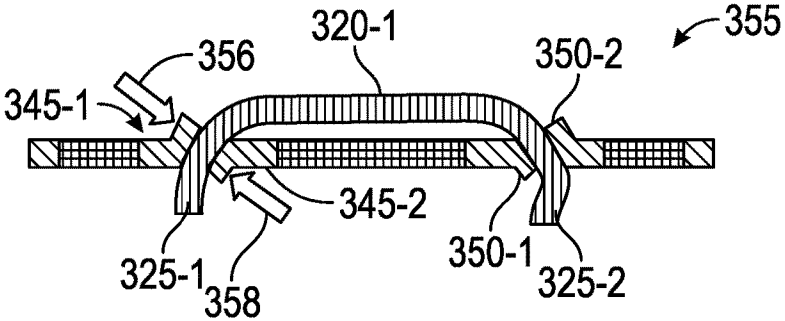
FIG. 3E is a top view of retaining a collapsible tote using an exemplary tote-retaining apparatus, according to one or more embodiments.
Figure 3D:
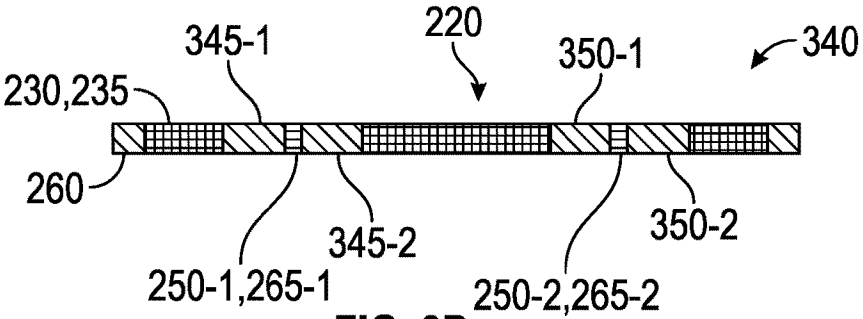
FIG. 3D is a top view of retaining a collapsible tote using an exemplary tote-retaining apparatus, according to one or more embodiments.

FIGS. 3D, 3E are top views 340, 355 of retaining a collapsible tote 305 using an exemplary tote-retaining apparatus 205, according to one or more embodiments. Portions 345-1, 345-2 of the engagement member 260 define the slot 265-1, and portions 350-1, 350-2 of the engagement member 260 define the slot 265-2. The view 340 depicts a neutral position of the engagement member 260, in which the portions 345-1, 345-2, 350-1, 350-2 are within the plane of the engagement member 260.

In the view 355, the handle 320-1 is inserted into the slots 265-1, 265-2, causing the portions 345-1, 345-2, 350-1, 350-2 to deform from the neutral position of the engagement member 260. When deformed, the portions 345-1, 345-2 apply forces to retain the portion 325-1 (shown as arrows 356, 358), and the portions 350-1, 350-2 apply forces to retain the portion 325-2. When the handle 320-1 is removed from the slots 265-1, 265-2, the engagement member 260 returns to the neutral position.

Figure 4:
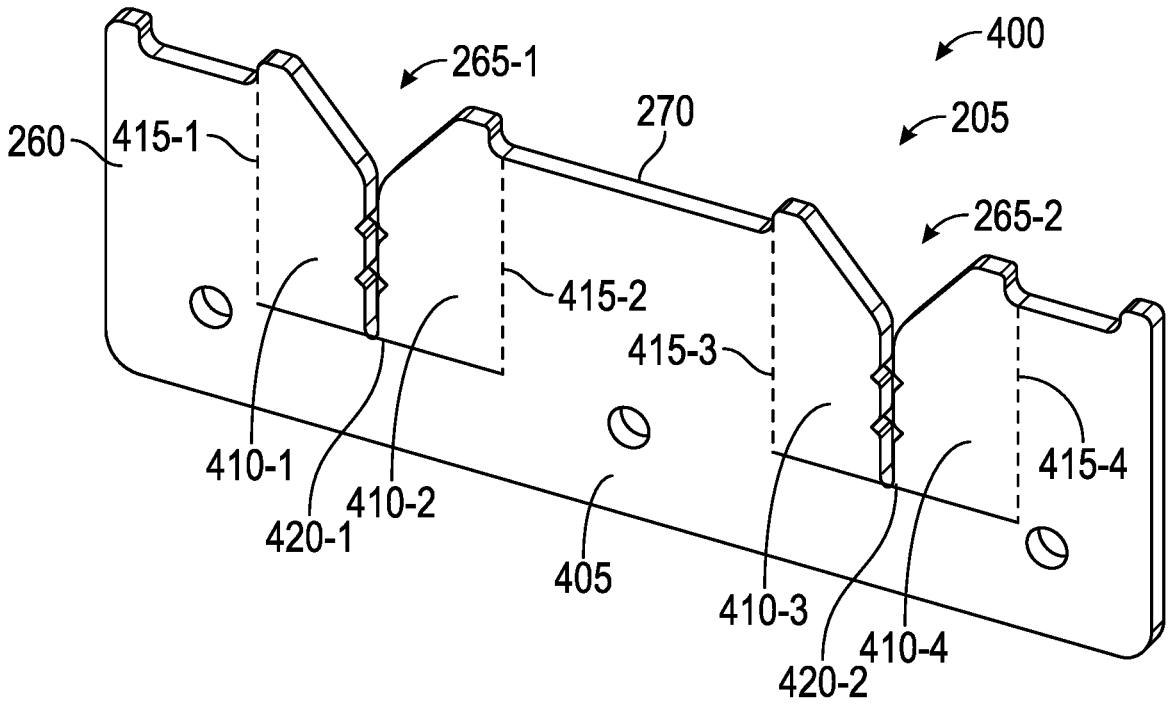
FIG. 4 is an exemplary hinged implementation of an engagement member, according to one or more embodiments.

FIG. 4 is an exemplary hinged implementation of an engagement member 260, according to one or more embodiments. The features illustrated in view 400 may be used in conjunction with other embodiments described herein. For example, the engagement member 260 may be used in the apparatus 205 of FIGS. 2A, 2B.

The engagement member 260 comprises a body member 405 that is pivotably coupled with doors 410-1, 410-2, 410-3, 410-4 (collectively or generically, door(s) 410) through respective pivot interfaces 415-1, 415-2, 415-3, 415-4 (collectively or generically, pivot interface(s) 415). The doors 410-1, 410-2 are dimensioned and arranged to define the slot 265-1 therebetween, and the doors 410-3, 410-4 are dimensioned and arranged to define the slot 265-2 therebetween. The body member 405 and the doors 410 may be formed of any suitable material(s), which may be rigid or flexible. In some embodiments, the body member 405 is formed of a same material(s) as the doors 410. In other embodiments, the body member 405 is formed of different material(s) than the doors 410.

As shown, the pivot interfaces 415 are arranged at lateral edges of the respective doors 410 and extend along a height dimension of the engagement member 260. The top edges of the doors 410 are included in the top surface 270 of the engagement member 260, and the bottom edges of the doors 410 are separated from the body member 405 by gaps 420-1, 420-2. The pivot interfaces 415 enable the respective doors 410 to rotate and/or translate into and out of a neutral position. One non-limiting example of the pivot interfaces 415 includes hinges. As shown, in the neutral position the doors 410 are coplanar with the body member 405. When pivoted, the doors 410 are no longer coplanar with the body member 405. In flexible implementations of the doors 410, the doors 410 may be configured to deform in addition to pivoting.

In some embodiments, one or more external biasing elements may urge the doors 410 to the neutral position. For example, one or more springs or spring-loaded components may contact one or more sides of the doors 410. In some embodiments, the pivot interfaces 415 comprise biasing elements, e.g., spring-loaded hinges.

Alternate arrangements of the pivot interfaces 415 are also contemplated. For example, the positioning of the pivot interfaces 415 and the gaps 420-1, 420-2 may be switched, such that the bottom edges of the doors 410 are coupled to the body member 405 through the pivot interfaces 415, and the lateral edges of the doors 410 are separated from the body member 405 by gaps.

Figure 6:
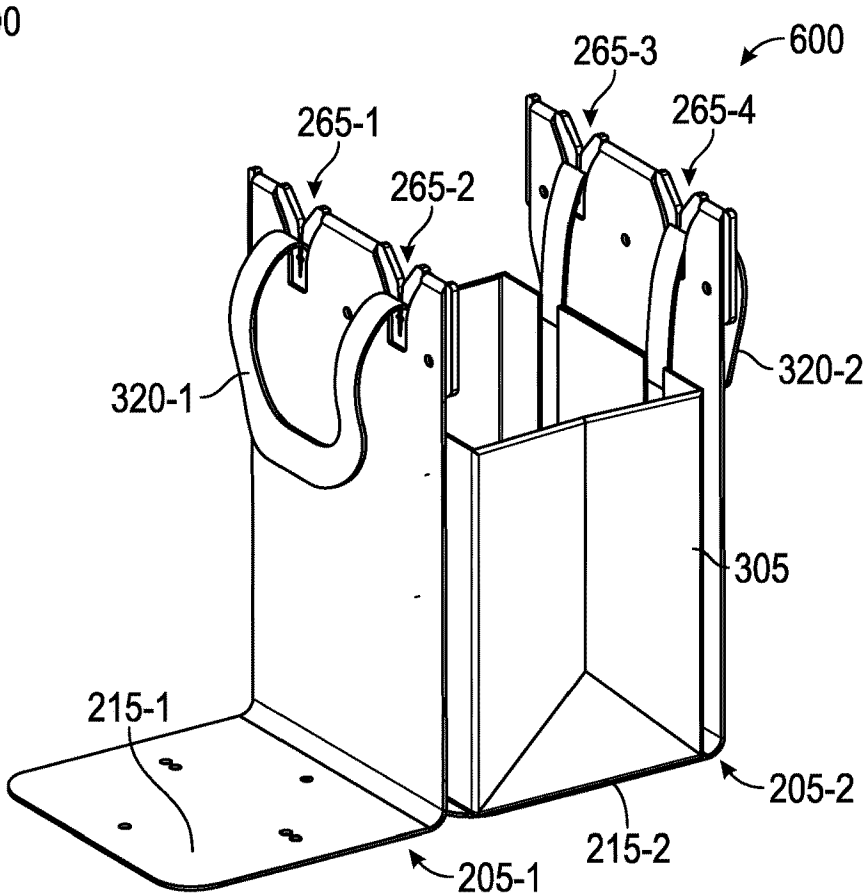
FIG. 6 is a perspective view of retaining a collapsible tote using two tote-retaining apparatus, according to one or more embodiments.
Figure 5:
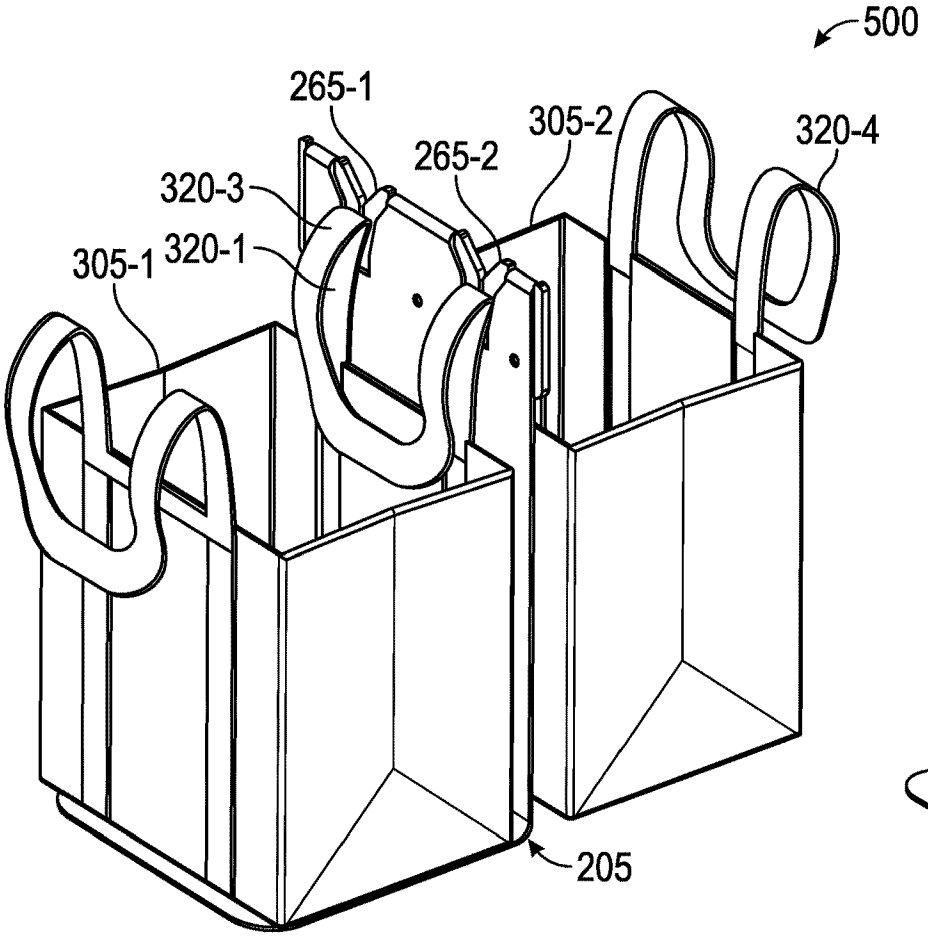
FIG. 5 is a perspective view of retaining two collapsible totes using a single tote-retaining apparatus, according to one or more embodiments.

FIGS. 5 and 6 illustrate alternate techniques for retaining one or more collapsible totes. More specifically, FIG. 5 is a perspective view 500 of retaining two collapsible totes 305-1, 305-2 using a single tote-retaining apparatus 205. The collapsible tote 305-2 includes handles 320-3, 320-4. The handle 320-1 of the collapsible tote 305-1 and the handle 320-3 of the collapsible tote 305-2 are engaged with the slots 265-1, 265-2. As discussed with reference to FIG. 2, in some cases the slots 265-1, 265-2 may define one or more notches, and each of the handles 320-1, 320-3 may be retained at or near a respective notch.

FIG. 6 is a perspective view 600 of retaining a collapsible tote 305 using two tote-retaining apparatus 205-1, 205-2, according to one or more embodiments. The tote-retaining apparatus 205-1, 205-2 are spaced apart such that the handle 320-1 is engaged with the slots 265-1, 265-2 of the tote-retaining apparatus 205-1, and the handle 320-2 is engaged with the slots 265-3, 265-4 of the tote-retaining apparatus 205-2. The collapsible tote 305 contacts a base 215-2 of the tote-retaining apparatus 205-2.

Figure 7B:
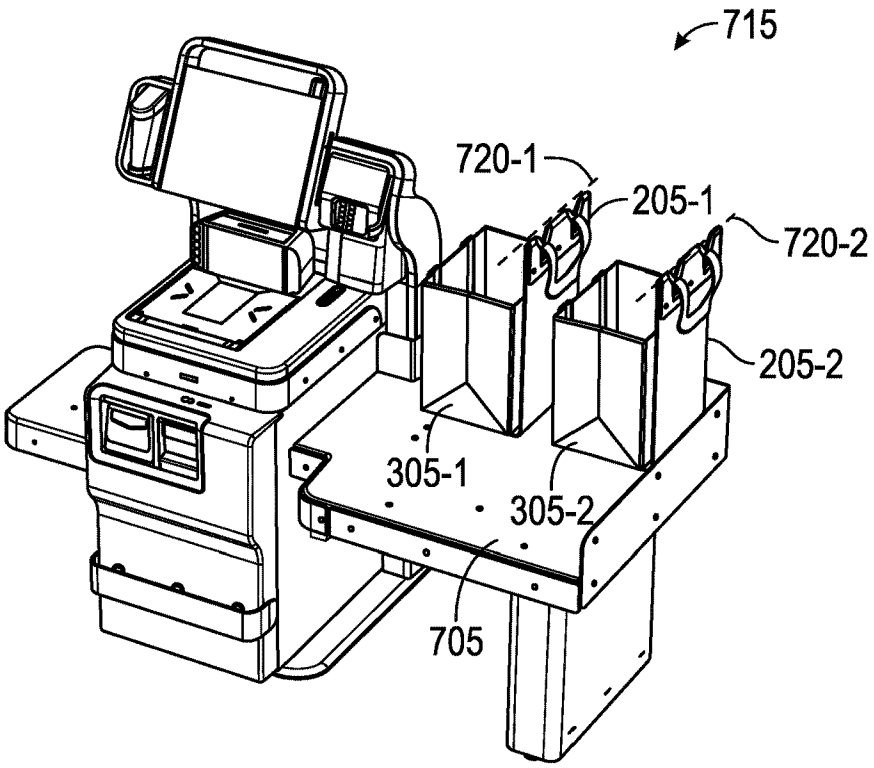
FIG. 7B is a perspective view of an exemplary self-checkout system having multiple tote-retaining apparatus on a fixed platform, according to one or more embodiments.
Figure 7A:
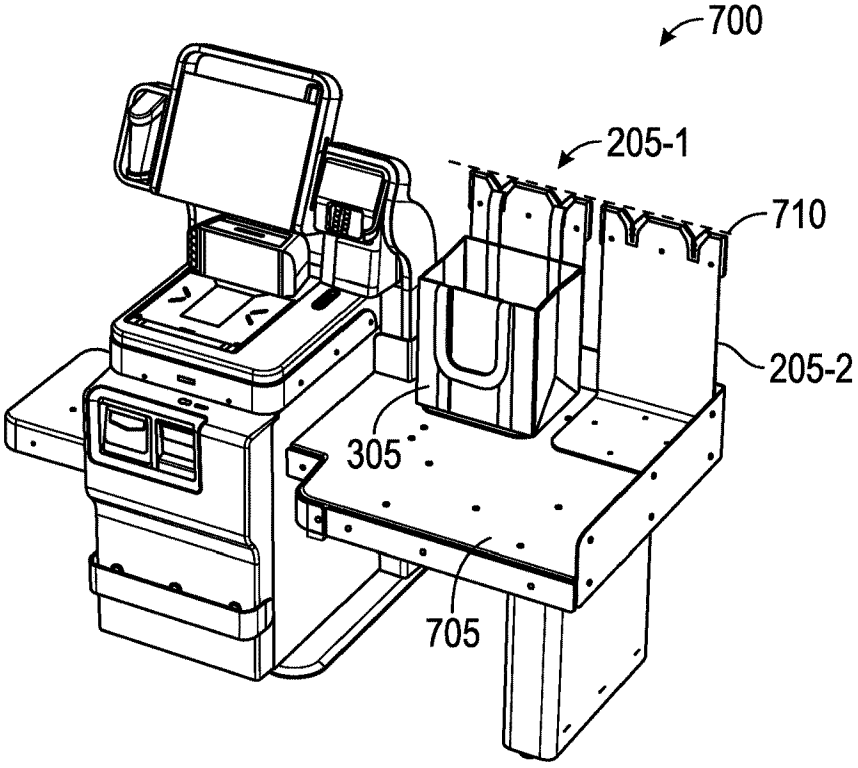
FIG. 7A is a perspective view of an exemplary self-checkout system having multiple tote-retaining apparatus on a fixed platform, according to one or more embodiments.
Figure 7D:
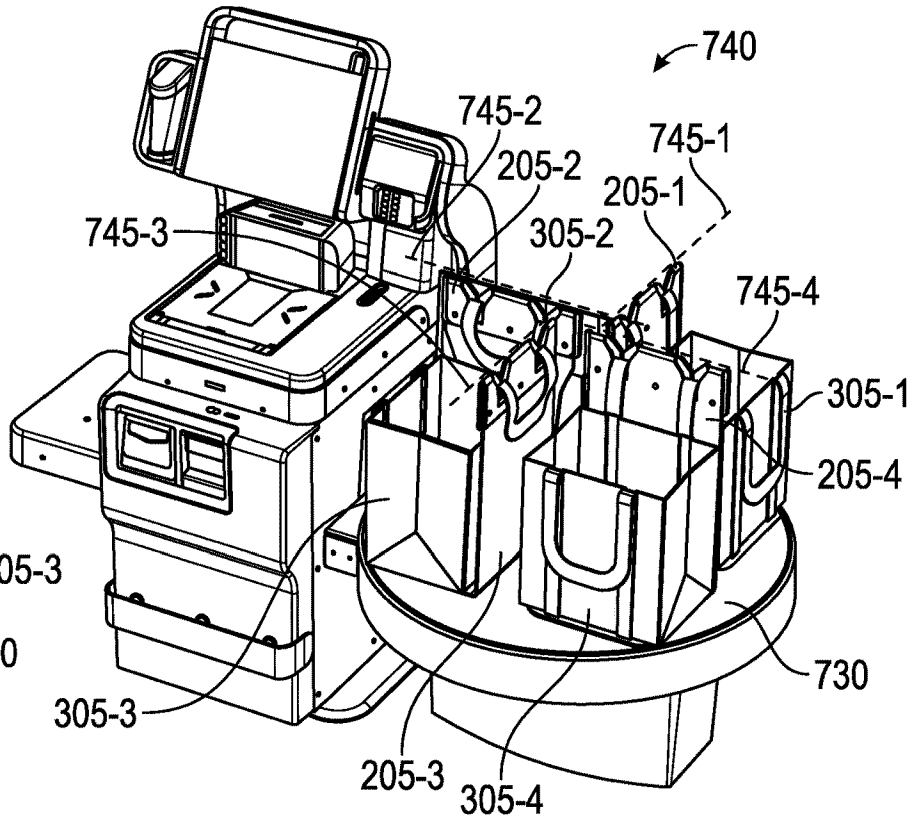
FIG. 7D is a perspective view of an exemplary self-checkout system having multiple tote-retaining apparatus on a rotatable platform, according to one or more embodiments.
Figure 7C:
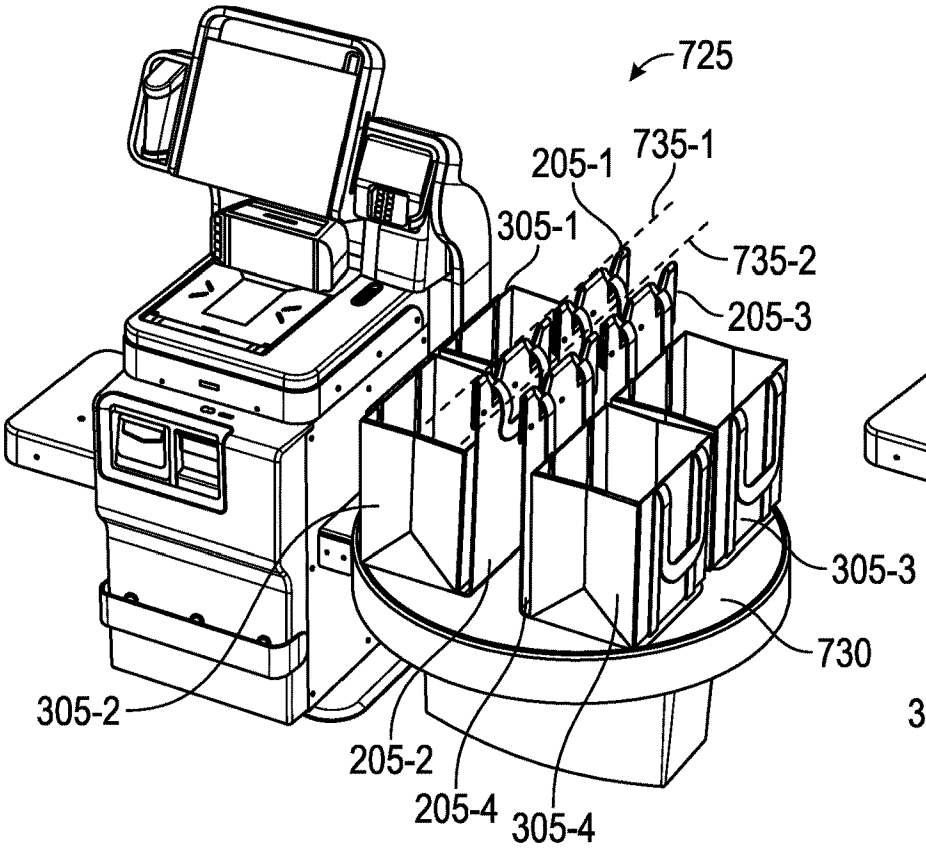
FIG. 7C is a perspective view of an exemplary self-checkout system having multiple tote-retaining apparatus on a rotatable platform, according to one or more embodiments.

FIGS. 7A, 7B are perspective views 700, 715 of an exemplary self-checkout system having multiple tote-retaining apparatus on a fixed platform 705, according to one or more embodiments. FIG. 7C, 7D are perspective views 725, 740 of an exemplary self-checkout system having multiple tote-retaining apparatus on a rotatable platform 730, according to one or more embodiments. The platforms 705, 730 may have any suitable dimensioning.

In the view 700, the projecting members of the tote-retaining apparatus 205-1, 205-2 are arranged along an axis 710 along a rear edge of the platform 705. The bases of the tote-retaining apparatus 205-1, 205-2 extend from the axis 710 toward the customer interaction area. In an alternate implementation, the axis 710 may be at a different location such that multiple collapsible totes 305 may be attached to each tote-retaining apparatus 205-1, 205-2.

In the view 715, the projecting member of the tote-retaining apparatus 205-1 is arranged along a first axis 720-1, and the projecting member of the tote-retaining apparatus 205-2 is arranged along a second axis 720-2. As shown, the first axis 720-1 and the second axis 720-2 are parallel to each other. The bases of the tote-retaining apparatus 205-1, 205-2 are arranged laterally inward (e.g., toward a center line of the self-checkout system) from the respective first axis 720-1 or second axis 720-2. In an alternate implementation, the first axis 720-1 and the second axis 720-2 are in a non-parallel arrangement.

In the view 725, the projecting member of the tote-retaining apparatus 205-1, 205-2 are arranged along a first axis 735-1, and the projecting member of the tote-retaining apparatus 205-3, 205-4 are arranged along a second axis 735-2. The bases of the tote-retaining apparatus 205-1, 205-2, 205-3, 205-4 are arranged laterally outward from the respective first axis 735-1 or second axis 735-2. Each of the tote-retaining apparatus 205-1, 205-2, 205-3, 205-4 supports a respective collapsible tote 305-1, 305-2, 305-3, 305-4. As shown, the first axis 735-1 and the second axis 735-2 are parallel to each other. In an alternate implementation, the tote-retaining apparatus 205-3, 205-4 may be omitted from the self-checkout system, and the first axis 735-1 is arranged along a center line of the platform 730 such that two tote-retaining apparatus 205-1, 205-2 support the four collapsible totes 305-1, 305-2, 305-3, 305-4.

In the view 740, the projecting member of the tote-retaining apparatus 205-1 is arranged along a first axis 745-1, the projecting member of the tote-retaining apparatus 205-2 is arranged along a second axis 745-2, the projecting member of the tote-retaining apparatus 205-3 is arranged along a third axis 745-3, the projecting member of the tote-retaining apparatus 205-4 is arranged along a fourth axis 745-4.

The bases of the tote-retaining apparatus 205-1, 205-2, 205-3, 205-4 are arranged laterally outward from the respective first axis 745-1, the second axis 745-2, the third axis 745-3, or the fourth axis 745-4. Each of the tote-retaining apparatus 205-1, 205-2, 205-3, 205-4 supports a respective collapsible tote 305-1, 305-2, 305-3, 305-4. As shown, the first axis 745-1 and the third axis 745-3 are parallel to each other, and the second axis 745-2 and the fourth axis 745-4 are parallel to each other, such that the tote-retaining apparatus 205-1, 205-2, 205-3, 205-4 are in a "pinwheel" arrangement.

Figure 9:
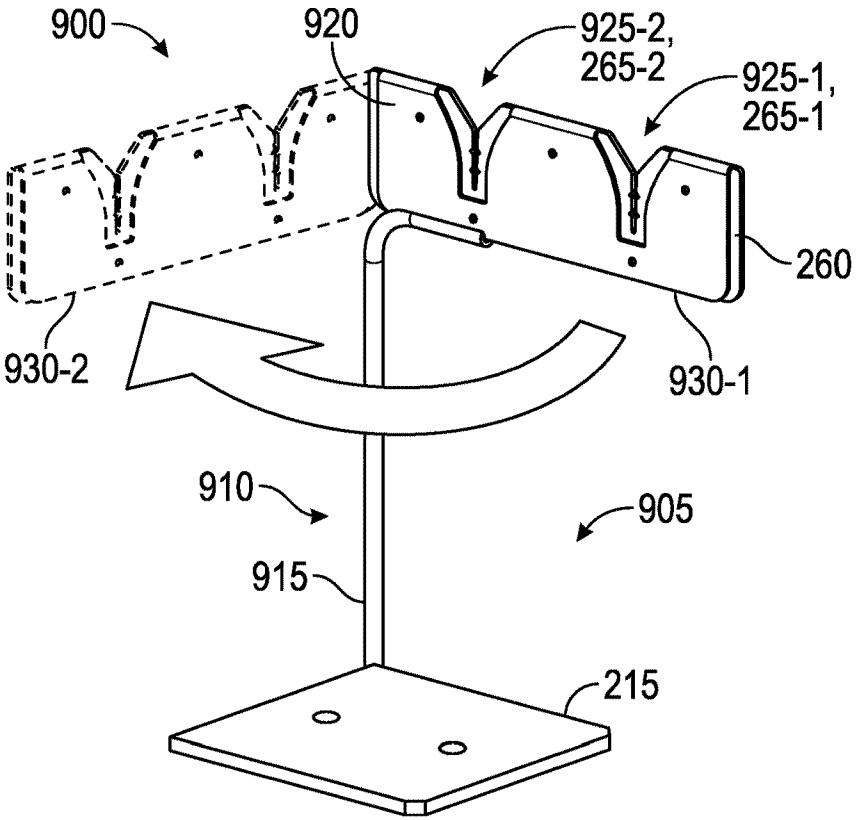
FIG. 9 is a perspective view of an exemplary tote-retaining apparatus having a rotatable engagement member, according to one or more embodiments.
Figure 8:
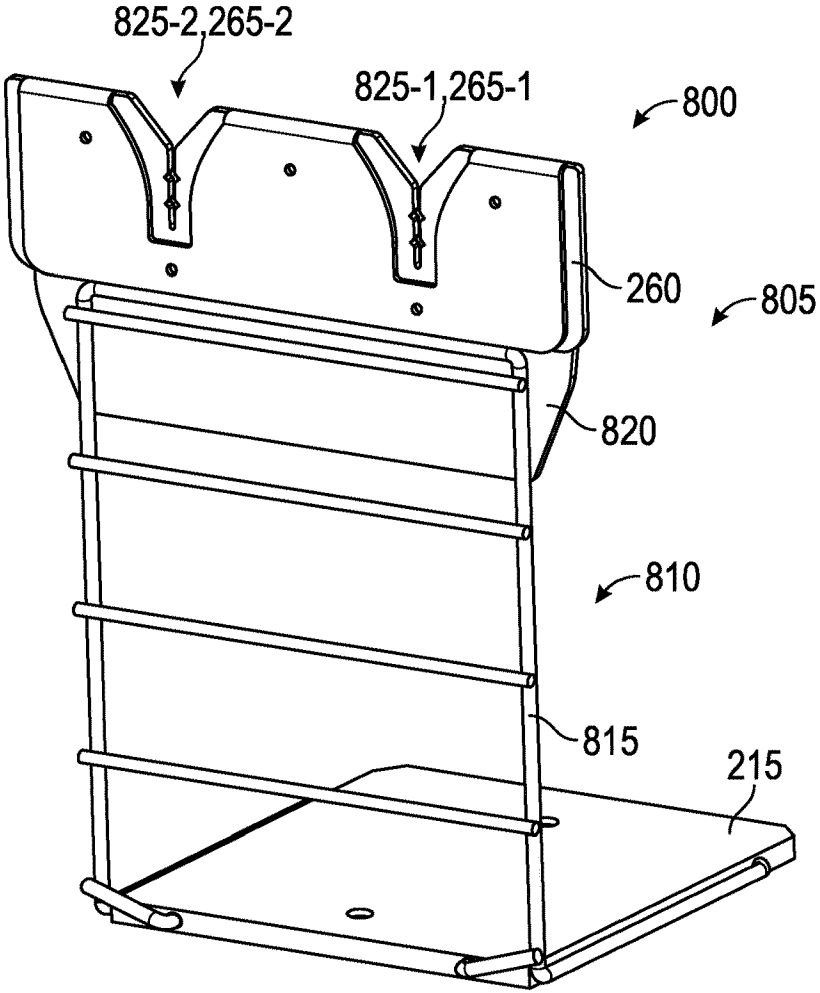
FIG. 8 is a perspective view of an exemplary tote-retaining apparatus having a wire-form projecting member, according to one or more embodiments.
Figure 10:
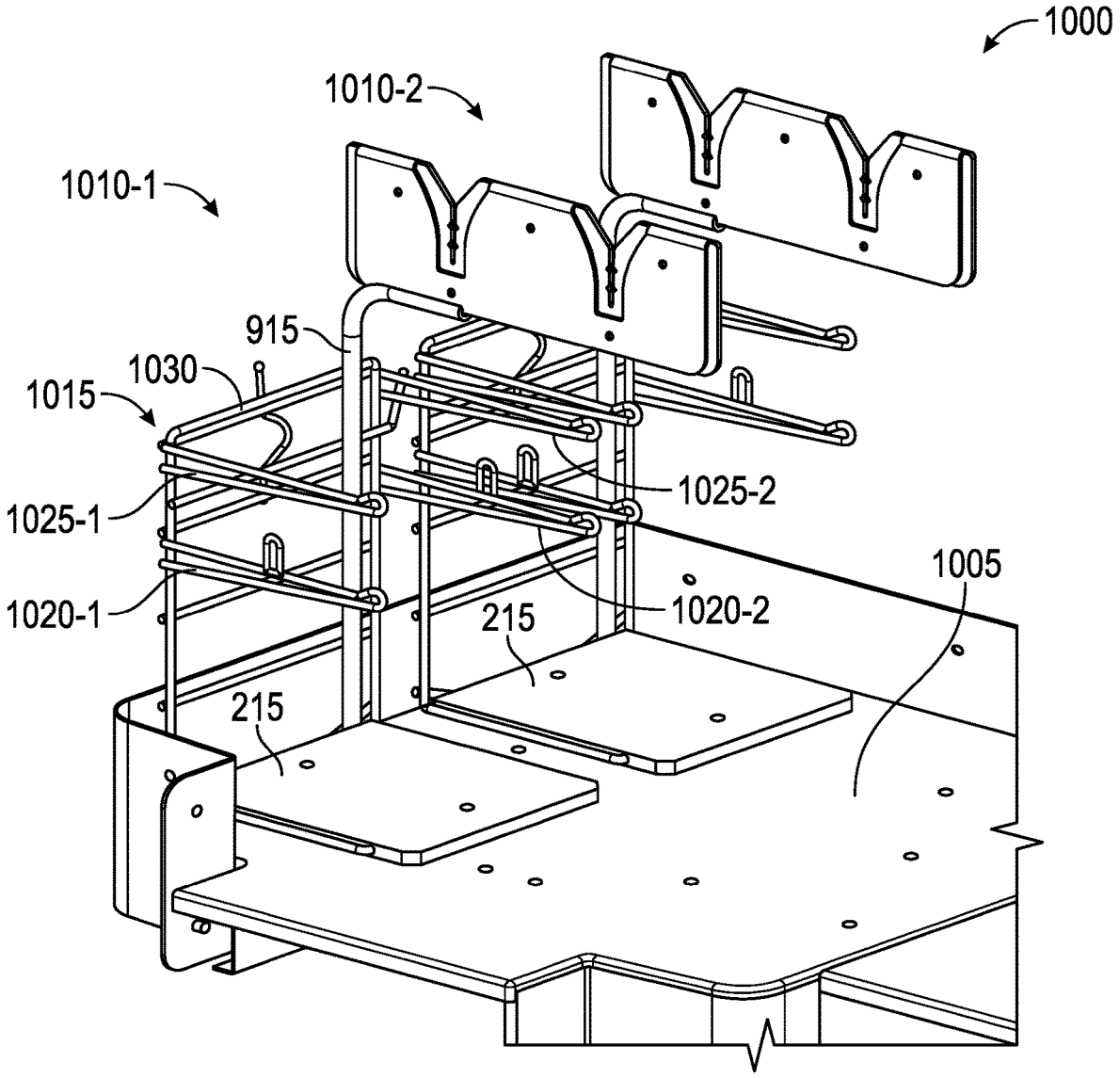
FIG. 10 illustrates an exemplary implementation of a self-checkout system having multiple tote-retaining apparatus and arms, according to one or more embodiments.

FIGS. 8, 9, and 10 illustrate alternate implementations of a tote-retaining apparatus. More specifically, FIG. 8 is a perspective view 800 of an exemplary tote-retaining apparatus 805 having a wire-form projecting member 815, according to one or more embodiments. The tote-retaining apparatus 805 comprises the base 215 and a projecting assembly 810 that projects upwardly between a first end and an opposing second end. The projecting assembly 810 is attached to the base 215 at the first end, and to the engagement member 260 at the second end. More specifically, the projecting assembly 810 comprises the wire-form projecting member 815 attached to the base 215, and an engagement projecting member 820 attached to the wire-form projecting member 815.

The engagement projecting member 820 may be configured similarly to the portion of the projecting member 220 near the second end 230 as depicted in FIG. 2. For example, the engagement projecting member 820 may be formed as two flange portions and a bend portion, and be may be dimensioned to receive the engagement member 260 in a channel defined between the flange portions. Each slot 265-1, 265-2 is arranged at a respective opening 825-1, 825-2 formed in the engagement projecting member 820.

FIG. 9 is a perspective view 900 of an exemplary tote-retaining apparatus 905 having a rotatable engagement member 260, according to one or more embodiments.

The tote-retaining apparatus 905 comprises the base 215 and a projecting assembly 910 that projects upwardly between a first end and an opposing second end. The projecting assembly 910 is attached to the base 215 at the first end, and to the engagement member 260 at the second end. More specifically, the projecting assembly 910 comprises a rod 915 attached to the base 215 and an engagement projecting member 920 attached to the rod 915.

The engagement projecting member 920 may be configured similarly to the engagement projecting member 820 as depicted in FIG. 2. For example, the engagement projecting member 920 may be formed as two flange portions and a bend portion, and be may be dimensioned to receive the engagement member 260 in a channel defined between the flange portions. Each slot 265-1, 265-2 is arranged at a respective opening 925-1, 925-2 formed in the engagement projecting member 920.

In some embodiments, the engagement projecting member 920 is rotatable relative to the rod 915. In other embodiments, the rod 915 is rotatable relative to the base 215. In this way, the engagement member 260 is rotatable relative to the base 215, between a first position 930-1 and a second position 930-2. In some cases, rotation of the engagement member 260 may be beneficial to rotate the engagement member 260 out of the way when not in use at a bagging station (e.g., a customer placing a large item on a platform, a customer filling a single-use plastic bag).

FIG. 10 illustrates an exemplary implementation of a self-checkout system 1000 having multiple tote-retaining apparatus 1010-1, 1010-2 and arms 1020-1, 1020-2, 1025-1, 1025-2, according to one or more embodiments. More specifically, the bases 215 of the tote-retaining apparatus 1010-1, 1010-2 are attached to a platform 1005 of the self-checkout system 1000.

Each of the tote-retaining apparatus 1010-1, 1010-2 comprises an instance of the tote-retaining apparatus 905 having the rotatable engagement member 260, as well as a wire-form frame 1015 attached to the base 215. As shown, the rod 915 is distinct from the wire-form frame 1015. However, other embodiments may have the rod 915 integrated into the wire-form frame 1015.

The wire-form frame 1015 comprises the arms 1020-1, 1020-2, 1025-1, 1025-2, each of which has a substantially horizontal orientation and is dimensioned to removably engage respective handles of a collapsible tote or of a single-use plastic bag. The arms 1020-1, 1020-2 are arranged as a first pair of arms at a first height from the base 215, and the arms 1025-1, 1025-2 are arranged as a second pair of arms at a second height from the base 215. The wire-form frame 1015 further comprises a crossbar 1030 at a third height from the base 215. The arms 1020-1, 1020-2,

1025-1, 1025-2, and/or the crossbar 1030 may include one or more projecting tabs dimensioned to removably engage handles of a collapsible tote or of a single-use plastic bag.

In some embodiments, the rotatable engagement member 260 may be rotated into a first position that is substantially parallel to, and overlapping with, the crossbar 1030, e.g., when a customer uses a collapsible tote at the self-checkout system 1000. The rotatable engagement member 260 may be selectively rotated away from the first position into a second position, e.g., when a customer places a large item on the platform 1005 or uses a single-use plastic bag with the wire-form frame 1015.

Figure 11C:
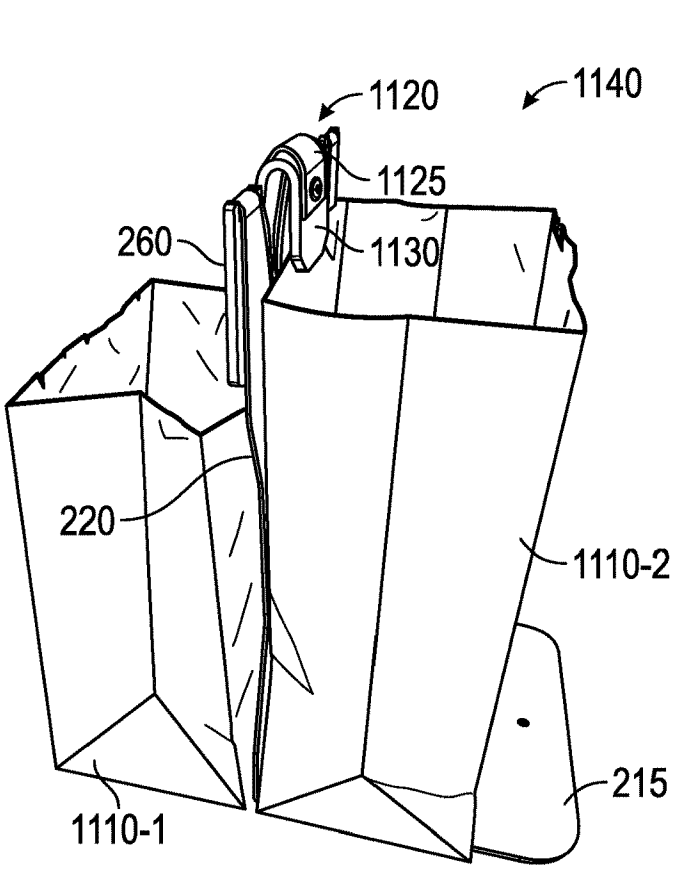
FIG. 11C is a perspective view of an exemplary tote-retaining apparatus capable of retaining a wall of a kraft paper bag, according to one or more embodiments.
Figure 11A:
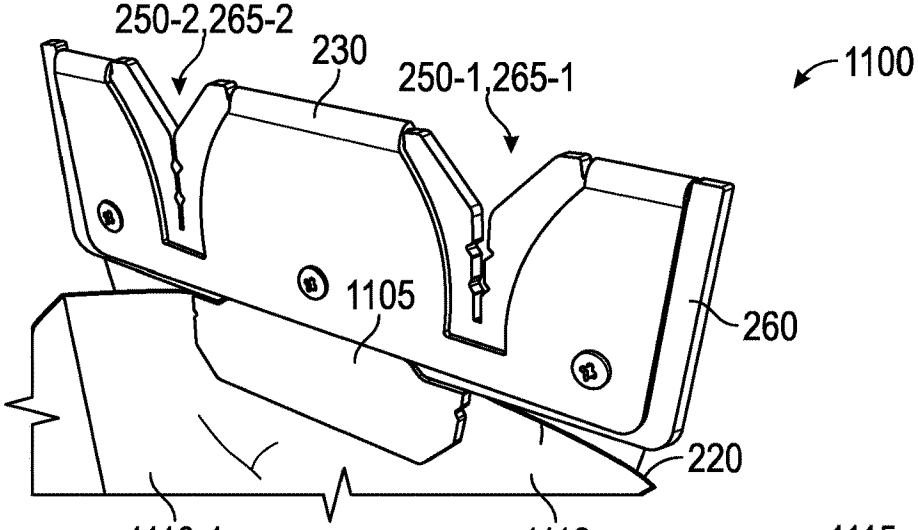
FIG. 11A is a perspective view of an exemplary tote-retaining apparatus capable of retaining a wall of a kraft paper bag, according to one or more embodiments.
Figure 11B:
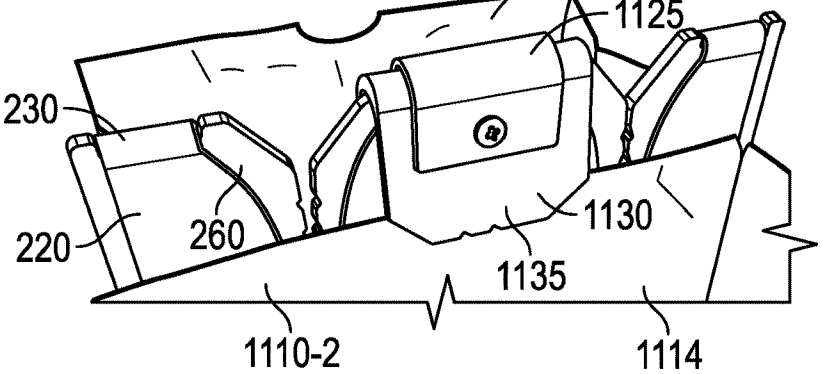
FIG. 11B is a perspective view of an exemplary tote-retaining apparatus capable of retaining a wall of a kraft paper bag, according to one or more embodiments.

FIGS. 11A, 11B, 11C are perspective views 1100, 1115, 1140 of an exemplary tote-retaining apparatus capable of retaining a wall of a kraft paper bag, according to one or more embodiments.

In the view 1100, the engagement member 260 defines a tab 1105 extending away from the second end 230 toward the first end. In some embodiments, the tab 1105 is integrally formed with the engagement member 260. A wall 1112 of a kraft paper bag 1110-1 may be slid between the tab 1105 and the projecting member 220, and the compliance of the tab 1105 causes the tote-retaining apparatus to retain the wall 1112 between the tab 1105 and the projecting member 220. In an alternate implementation, the tab 1105 may be elastically biased toward the projecting member 220, e.g., using a spring. The kraft paper bag 1110-1 may be disengaged from the tab 1105 by applying a downward force to the wall 1112.

In the view 1115, an engagement assembly 1120 is attached to the projecting member 220 at the second end 230. The engagement assembly 1120 comprises a metal bracket 1125 and a second engagement member 1130. The metal bracket 1125 may removably attach to the projecting member 220 using any suitable means, e.g., threaded fasteners extending through aligned openings in the metal bracket 1125, the second engagement member 1130, and/or the projecting member 220.

The second engagement member 1130 may be formed of any suitable material. In some embodiments, the second engagement member 1130 is formed of a same flexible material as the engagement member 260. In some embodiments, the metal bracket 1125 urges the second engagement member 1130 into a folded configuration, such that the second engagement member 1130 extends over the second end 230 and partly overlaps both sides of the projecting member 220. In some embodiments, the second engagement member 1130 may form a tab 1135.

A wall 1114 of a kraft paper bag 1110-2 may be slid between the tab 1135 and the projecting member 220, and the compliance of the tab 1135 causes the tote-retaining apparatus to retain the wall 1114 between the tab 1135 and the projecting member 220. In an alternate implementation, the tab 1135 may be elastically biased toward the projecting member 220, e.g., using a spring. The kraft paper bag 1110-2 may be disengaged from the tab 1135 by applying a downward force to the wall 1114.

In this way, the tote-retaining apparatus of FIGS. 11A-11C may be capable of accommodating different types of bags and totes. As shown in the view 1140, the tote-retaining apparatus may engage two kraft paper bags 1110-1, 1110-2, two collapsible totes, or a combination of one kraft paper bag and one collapsible tote. Further, although described in terms of collapsible totes and kraft paper bags, the features of the tote-retaining apparatus may also be capable of accommodating other types of bags, such as single-use plastic bags.

Figure 12:
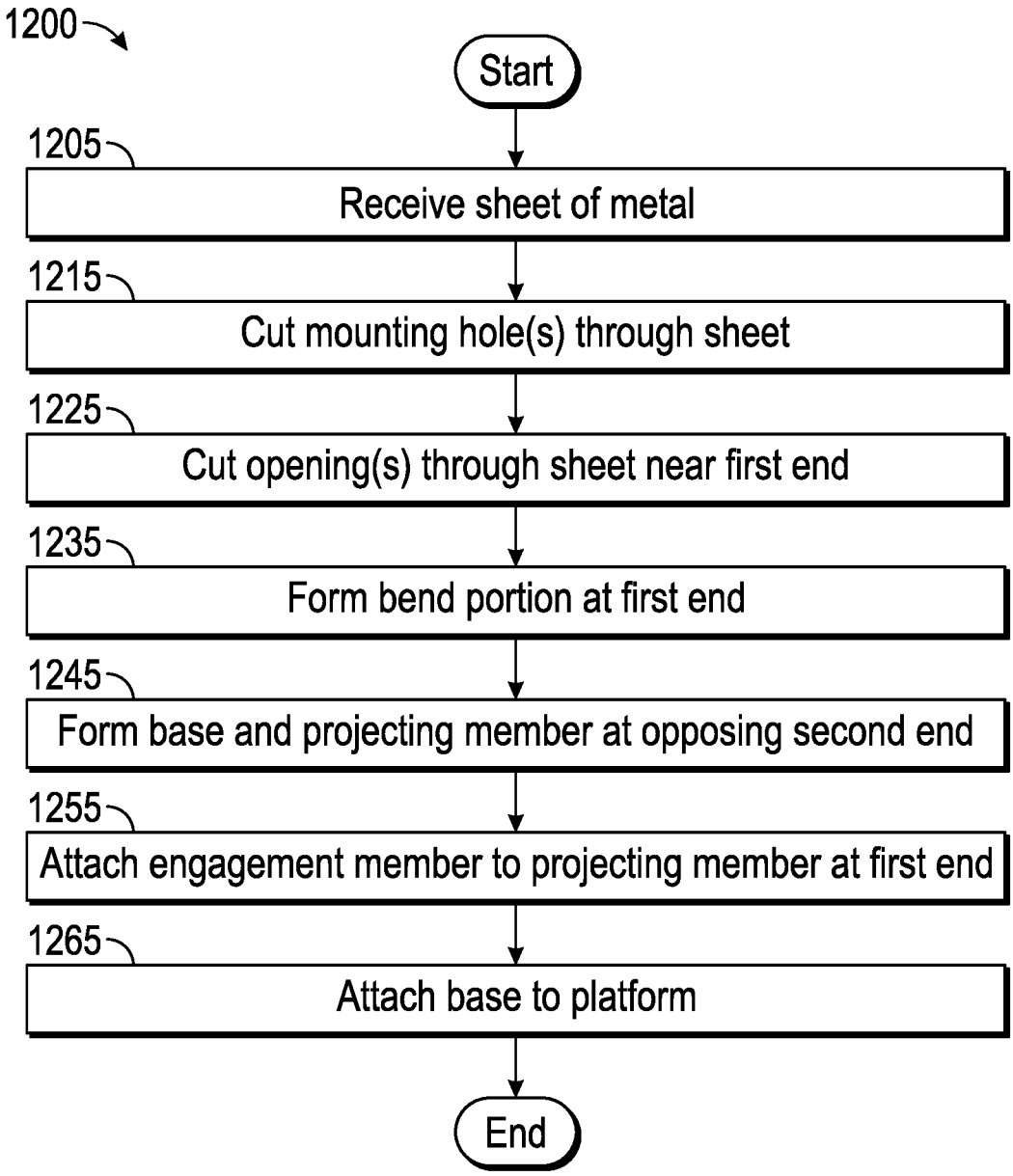
FIG. 12 is an exemplary method of fabricating a tote-retaining apparatus, according to one or more embodiments.

FIG. 12 is an exemplary method 1200 of fabricating a tote-retaining apparatus, according to one or more embodiments. The method 1200 may be used in conjunction with other embodiments, such as fabricating the tote-retaining apparatus of FIGS. 2A and 2B.

The method 1200 begins at block 1205, where a sheet of metal is received. Some non-limiting examples of the type of metal include spring steel and aluminum. At block 1215, one or more mounting holes are cut through the sheet. At block 1225, one or more openings are cut through the sheet near a first end of the sheet. The cutting operations of blocks 1215, 1225 may be performed using any suitable cutting tool. In some embodiments, the cutting operation is performed by a laser cutter.

At block 1235, the sheet is bent to form a bend portion at the first end of the sheet. At block 1245, the sheet is bent to form a base and projecting member at a second end of the sheet opposing the first end. The bending operations of blocks 1235, 1245 may be performed using any suitable bending tool. In some embodiments, the bending operation is performed by a press brake (e.g., a punch and a die) or a stretch press.

At block 1255, an engagement member is attached to the projecting member at the first end of the sheet. In some embodiments, the engagement member is welded or adhered to the projecting member. In other embodiments, the engagement member is attached to the projecting member using threaded fasteners.

At block 1265, the base is attached to a platform. In some embodiments, the platform is defined by a structure of a self-checkout system. In some embodiments, the base is welded or adhered to the platform. In other embodiments, the base is attached to the platform using threaded fasteners inserted through the one or more mounting holes. The method 1200 ends following completion of block 1265.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

In the preceding, reference is made to embodiments presented in this disclosure. However, the scope of the present disclosure is not limited to specific described embodiments. Instead, any combination of the features and elements described herein, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the aspects, features, embodiments and advantages described herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

Aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system."

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the FIGS. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the foregoing is directed to embodiments of the present invention, other and further embodiments of the invention may be devised without departing from the basic scope thereof, and the scope thereof is determined by the claims that follow.

What is claimed is:

1. An apparatus for retaining a collapsible tote, the apparatus comprising:

a base;

a projecting member comprising a bend portion between two flange portions and having a first end attached to the base, wherein the base and the projecting member are integrally formed of a sheet of metal; and an engagement member attached to the projecting member at a second end opposite the first end, wherein the bend portion defines the second end of the projecting member, wherein the engagement member is arranged between the two flange portions and defines one or more slots extending into the engagement member from a top surface, and wherein, at each slot of the one or more slots, portions of the engagement member that define the slot are configured to, responsive to receiving a respective portion of a handle of the collapsible tote into the slot, apply a force to retain the respective portion of the handle, wherein each slot of the one or more slots is arranged at a respective opening formed in the bend portion and the two flange portions.

2. The apparatus of claim 1, wherein the engagement member is formed of a flexible material.

3. The apparatus of claim 2, wherein the flexible material comprises one or more of silicone, neoprene, polycarbonate, polyethylene, and styrene.

4. The apparatus of claim 1, wherein a plurality of first openings are formed through the engagement member, each first opening aligned with respective second openings that are formed through the two flange portions, and wherein the engagement member is attached to the projecting member using fasteners extending through the first openings and through the respective second openings.

5. The apparatus of claim 1, wherein the respective portions of the engagement member are dimensioned such that each slot of the one or more slots defines:

a first slot portion that tapers from a first width at the top surface to a smaller, second width.

6. The apparatus of claim 5, wherein the respective portions of the engagement member are dimensioned such that each slot of the one or more slots further defines:

a second slot portion extending from the first slot portion away from the top surface, wherein the second slot portion has a varying width and defines one or more notches.

7. The apparatus of claim 1, wherein, at each slot of the one or more slots, the portions of the engagement member that define the slot are configured to repeatably deform or pivot from a neutral position responsive to receiving the respective portion of the handle into the slot.

8. The apparatus of claim 1, wherein the engagement member defines a tab extending away from the second end toward the first end, wherein the apparatus is configured to retain a wall of a kraft paper bag between the tab and the projecting member.

9. The apparatus of claim 1, further comprising:

a second engagement member attached to the projecting member at the second end, wherein the apparatus is configured to retain a wall of a kraft paper bag between the second engagement member and the projecting member.

10. A self-checkout system comprising:

one or more platforms; and a plurality of bagging stations, wherein each bagging station comprises:

a base attached with a platform of the one or more platforms;

a projecting member comprising a bend portion between two flange portions and having a first end attached to the base, wherein the base and the projecting member are integrally formed of a sheet of metal; and an engagement member attached to the projecting member at a second end opposite the first end, wherein the bend portion defines the second end of the projecting member, wherein the engagement member is arranged between the two flange portions and defines one or more slots extending into the engagement member from a top surface, wherein, at each slot of the one or more slots, portions of the engagement member that define the slot are configured to, responsive to receiving a respective portion of a handle of a collapsible tote into the slot, apply a force to retain the respective portion of the handle, wherein each slot of the one or more slots is arranged at a respective opening formed in the bend portion and the two flange portions.

11. The self-checkout system of claim 10, wherein the one or more platforms are rotatable.

12. The self-checkout system of claim 10, wherein each engagement member is formed of a flexible material.

13. The self-checkout system of claim 10, wherein the respective portions of the engagement member are dimensioned such that each slot of the one or more slots defines:

a first slot portion that tapers from a first width at the top surface to a smaller, second width.

14. The self-checkout system of claim 13, wherein the respective portions of the engagement member are dimensioned such that each slot of the one or more slots further defines:

a second slot portion extending from the first slot portion away from the top surface, wherein the second slot portion has a varying width and defines one or more notches.

* * * * *